US006914216B1

(12) United States Patent
Chen

(10) Patent No.: US 6,914,216 B1
(45) Date of Patent: Jul. 5, 2005

(54) DIGITAL CONTROL AIR HEATING ELECTRIC BLANKET

(76) Inventor: Mao-Sung Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/921,100

(22) Filed: Aug. 19, 2004

(51) Int. Cl.[7] ..... H05B 1/00
(52) U.S. Cl. ..... 219/212; 219/529; 219/549
(58) Field of Search ..... 219/212, 529, 219/549

(56) References Cited

U.S. PATENT DOCUMENTS 2,432,785 A * 12/1947 Moberg ..... 219/212
2,998,502 A * 8/1961 Woodling ..... 219/212
3,193,664 A * 7/1965 Beery ..... 219/549
3,334,216 A * 8/1967 Illingworth ..... 219/528
3,437,792 A * 4/1969 Lauck ..... 219/505
3,564,203 A * 2/1971 Naoi et al. ..... 219/491
3,739,142 A * 6/1973 Johns ..... 219/491
3,889,101 A * 6/1975 Woods ..... 219/527
4,106,477 A * 8/1978 Feld ..... 126/263.05
6,653,607 B2 * 11/2003 Ellis et al. ..... 219/528

* cited by examiner

*Primary Examiner*—Robin O. Evans
*Assistant Examiner*—Vinod Patel

(57) ABSTRACT

A digital control wet heating type of electric blanket for heating air, comprised of a mattress containing a tenacious, air permeable cotton cloth consistently paved with hearing wires, cotton strip on the heating wires, a compression strip passing through the cotton fabric to compress the cotton strip on the heating wires, multiple temperature sensors provided between cotton fabric and cotton strip, a temperature protection circuit disposed to the heating wires, signals from sensor and protection circuit being externally connected to a digital control box; and the mattress being sealed and placed into a surface fluffed flannelette cover.

1 Claim, 4 Drawing Sheets

DIGITAL CONTROL AIR HEATING ELECTRIC BLANKET

BACKGROUND OF THE INVENTION (a) Technical Field of the Invention

The present invention is related to an air heating electric blanket, and more particularly to one provided with a digital control to prevent the user from getting burned by the electric blanket.

(b) Description of the Prior Art

The elderly or people with poor circulation may rely upon electric blankets or other similar equipment to warm them during the wintertime. The electric blanket is affordable and very popular. The electric blanket generally available in the market has a PVC material covered up with electric heating wires. However, the heat generated is prevented from being effectively diffused, resulting in burnt out areas of the PVC material which may then burn the skin. The control of the circuit of the heating wires is done by a comparatively conventional electronic means, often resulting in misjudgment and malfunction.

SUMMARY OF THE INVENTION

The primary purpose of the present invention is to provide a digital control air heating electric blanket that heats up the air to warm up a human body without getting burnt, adapted with a digital control. To achieve the purpose, a tenacious, air permeable cotton fabric without a specific form is consistently surrounded with silicone coated heating wires. A cotton strip is paved on the heating wire with both sides of the heating wires slightly protruding out of both sides of the cotton strip. A through hole is each provided on both sides of the cotton fabric in relation to its surrounding heating wires to permit a plastic compression strip to penetrate. The compression strip holds down upon the cotton strip to compress it on the heating wires. Multiple temperature sensors are provided between the cotton fabric and the cotton strip; and a temperature protection circuit is provided at where approximately to the heating wires. Signals from those sensors and the protection circuit are transmitted to a digital control circuit in a control box externally connected to the electric blanket. The digital control circuit performs digital control and protection based on signal feedbacks from those sensors and the protection circuit. The user may find out the temperature of the electric blanket at any time by reading from an LCD on the control box. The cotton fabric, the heating wires and the cotton strip are placed into a cotton mattress and sealed before being placed into a flannelette cover with a fluffed surface. Whereas the mattress is air permeable, the heating wires heat the air to produce wet hot gas to warm up the user without exposing to the danger of getting burnt.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
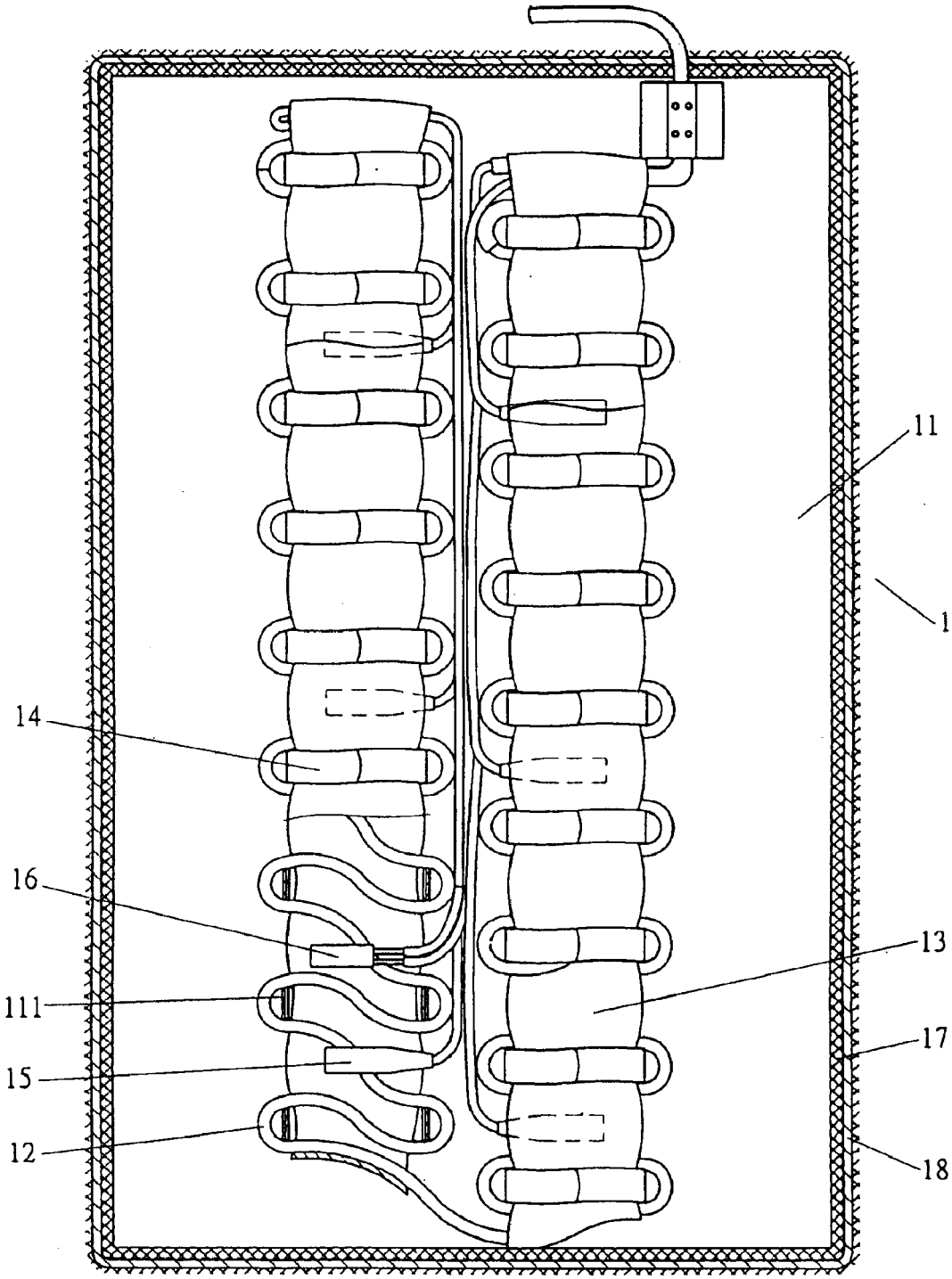
FIG. 1 is a sectional view of the present invention.
Figure 1A:
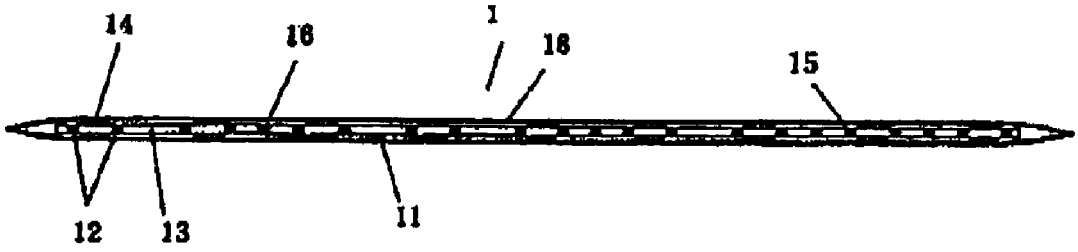
FIG. 1A is a sectional view of FIG. 1.
Figure 2:
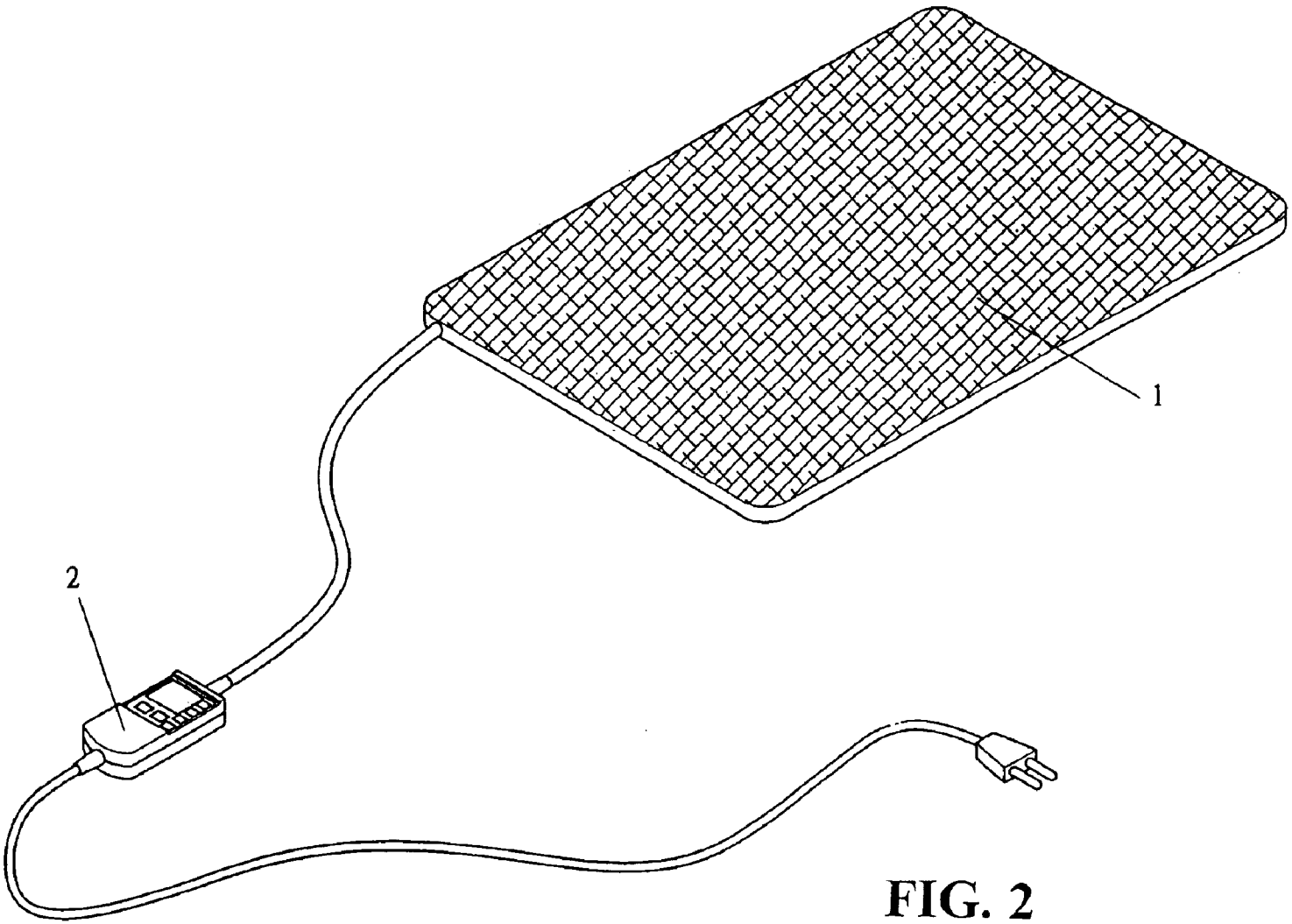
FIG. 2 is a perspective view of an assembly of the present invention.
Figure 3:
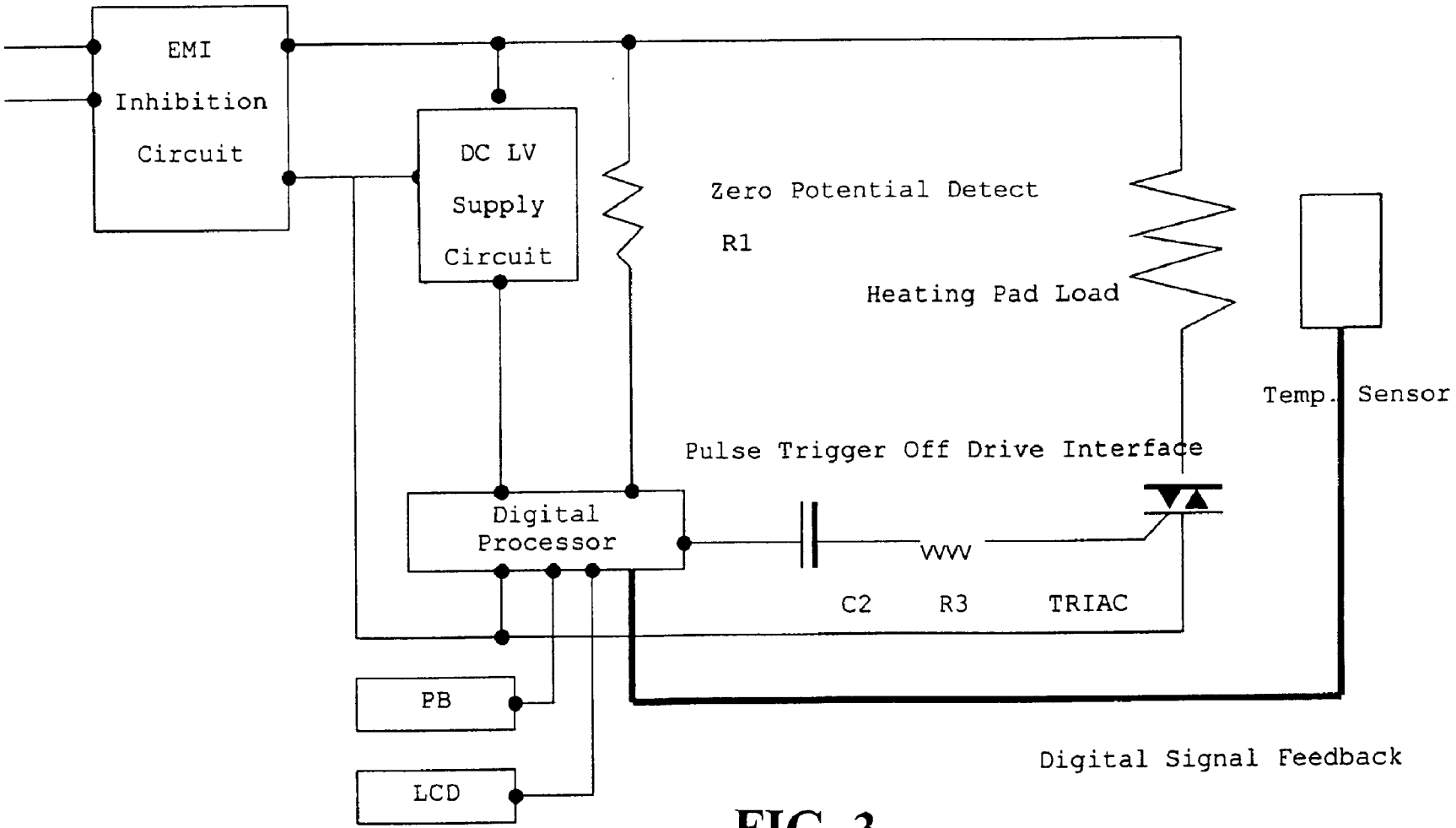
FIG. 3 is a drawing of a digital control circuit of the present invention.

Referring to FIGS. 1, 1A, 2, and 3, the present invention relates to a digital control wet heating type of an electric blanket 1. Wherein, a tenacious, air permeable cotton fabric 11 without a specific form is consistently surrounded with silicone coated heating wires 12. A cotton strip 13 is paved on the heating wires 12 with both sides of the heating wires 12 slightly protruding out of both sides of the cotton strip 13. A through hole 111 is each provided on both sides of the cotton fabric 11 in relation to its surrounding heating wires 12 to permit a plastic compression strip 14 to penetrate. The compression strip 14 holds down upon the cotton strip 13 to compress it on the heating wires 12. Multiple temperature sensors 15 are provided between the cotton fabric 11 and the cotton strip 13; and a temperature protection circuit 16 is provided at where approximately to the heating wires 12. Signals from those sensors 15 and the protection circuit 16 are transmitted to a digital control circuit in an externally control box 2 connected to the electric blanket 1. The digital control circuit performs digital control and protection based on signal feedbacks from those sensors 15 and the protection circuit 16. The user may find out the temperature of the electric blanket 1 at any time by reading from the LCD on the control box 2. The cotton fabric 11, the heating wires 12 and the cotton strip 13 are placed into a cotton mattress 17 and sealed before being placed into a flannelette cover 18 with a fluffed surface. Whereas the mattress 17 is air permeable, the heating wires heat the air to produce wet hot gas to warm up the user without exposing to the danger of getting burnt.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A digital control wet heating type of an electric blanket for heating air to produce wet hot gas to warm up the user without exposing to the danger of getting burnt, is comprised of a tenacious, air permeable cotton material without a specific from consistently surrounded with multiple heating wires; each heating wire being coated with silicone; a cotton strip being paved on the heating wires; both sides of the heating wires slightly protruding out of both sides of the cotton strip; a through hole being each provided on both sides of the cotton fabric in relation to its surrounding heating wires to permit a plastic compression stick to penetrate; the compression strip holding down upon the cotton strip to compress it on the heating wires; multiple temperature sensors being provided between the cotton fabric and the cotton strip; a temperature protection circuit being provided at where approximately to the heating wires; signals from those sensors and the protection circuit being transmitted to a digital control circuit in an externally connect control box; the digital control circuit performs digital control and protection based on signal feedbacks from those sensors and the protection circuit; an LCD on the control box indicating the temperature of the electric blanket; the cotton material, the heating wires and the cotton strip being placed into a cotton mattress and sealed; and the mattress being further placed into a flannelette cover with a fluffed surface.

* * * * *